US005586453A

United States Patent [19]

Frullini et al.

[11] Patent Number: 5,586,453

[45] Date of Patent: Dec. 24, 1996

[54] METHOD AND APPARATUS FOR TREATING STITCHES OF KNIT ARTICLES

[76] Inventors: Alberto Frullini; Paolo Frullini, both of Via di Brozzi 151/A, 50145 Firenze, Italy

[21] Appl. No.: 519,115

[22] Filed: Aug. 24, 1995

[30] Foreign Application Priority Data

Sep. 7, 1994 [IT] Italy ..... FI94A170

[51] Int. Cl.[6] ..... D04B 9/40

[52] U.S. Cl. ..... 66/148

[58] Field of Search ..... 66/148, 147, 58

[56] References Cited

U.S. PATENT DOCUMENTS

| | | | |
|---|---|---|---|
| 1,542,593 | 6/1925 | Williams | 66/148 |
| 1,544,085 | 6/1925 | Williams | 66/148 |
| 1,612,684 | 12/1926 | Williams | 66/148 |
| 1,743,948 | 1/1930 | Williams | 66/148 |
| 2,062,935 | 12/1936 | Roinestad | 66/148 |
| 2,107,548 | 2/1938 | Riggs et al. | 66/148 |

FOREIGN PATENT DOCUMENTS

| | | | |
|---|---|---|---|
| 405320 | 12/1909 | France | 66/148 |

*Primary Examiner*—John J. Calvert
*Attorney, Agent, or Firm*—McGlew and Tuttle

[57] ABSTRACT

Apparatus for the removal of one or more stitches of a knit article from the needles of a knitting machine and for the transfer and placement thereof onto other knitting members of the same or other machine. The apparatus including a device for driving each of the needles forming the stitches in the direction of their respective longitudinal axis; a device for removal of the stitches from the needles and the transfer thereof onto other knitting members of the same or other machine; and a device for supporting and/or driving the device for the removal and transfer of the stitches.

26 Claims, 12 Drawing Sheets

METHOD AND APPARATUS FOR TREATING STITCHES OF KNIT ARTICLES

FIELD OF THE INVENTION

The present invention refers to a method and an apparatus for the removal of one or more stitches of a knitted article from the needles of a knitting machine, and the transfer and placement thereof onto other knitting members of the same or other machine.

BACKGROUND OF THE INVENTION

As it is known to those skilled in the art, in the knitting machines, especially of rectilinear type such as the so-called Cotton looms, in order to carry out the various operations following the formation of a knitted article, for example the hooking up of two different parts of the same article, provision is made for removing the last-formed stitches from the respective knitting needles by means of members called "punches" in the field. The punches perform the covering of the needles and thus the transfer of the stitches from the needles to the punches. The thus removed stitches are transferred, together with the punches, onto other needles of the same or different machine. The term "covering" refers to a condition generated by a temporary coupling between the head of the punch and the head of the needle. One is lined up with the other continuously, so as to allow the transfer of a stitch from the needle to the punch and/or vice versa, with no obstacles. The punches are in the same number as the knitting needles loaded with the stitches to be removed, so shaped as to able to be hooked head o up to the crook of the needles, and arranged in blocks, usually referred to as "combs", each of which comprises a preset number of punches. However, driving the known combs is a difficult, manually operated operation which calls for a good amount of experience at the hands of skilled labor and brings about a high production cost of the finished product. In addition to this, their application to circular machines is difficult to carry out because of the complexity of the mechanical members needed for the automatic execution of the operations.

SUMMARY AND OBJECTS OF THE INVENTION

The main object of the present invention is to overcome the above drawbacks.

This result has been achieved, according to the invention, by providing a operative method comprising the preliminary step of manufacturing a knit article with a machine provided with a plurality of automatic knitting needles, especially of latch or skid type, that is of compound type, and with a stitch-casting off plane. The method including, for each article stitch to be removed and transferred, the following operating steps:

lifting the knitting needle which bears the stitch so as to place the latter in an unloaded condition onto the needle, that is, below the respective latch or skid, and in open condition;

lowering the thus lifted needle so as to force the stitch to place itself onto the casting off plane of the machine and, by a further lowering, to force the stitch into motion on the needle neck until it places itself i the vicinity of the respective latch or skid and in open condition;

lowering further the needle so as to cause the closing of the respective latch or the actuation of the skid on the needle head by means of the same stitch and, prior to the complete closing of the latch or to the actuation of the needle skid, moving a stitch-removing member close to the needle head until it comes in contact with the latter, so as to perform the covering of both the needle and the removal member upon the closing of the latch or skid;

lowering still further the needle along with the stitch-removing member, for the insertion thereof into the same stitch and thereby achieving the automatic transfer of the needle onto the removal member;

transferring the thus removed stitch elsewhere to place it, for example, onto a needle or other member of the same or other knitting machine.

Advantageously, according to the invention, the thus removed stitches may be in any number, depending on the structural characteristics of the article and of the knitting machine provided for the formation thereof. The stitches being possibly able to be removed in groups of adjacent stitches, with each group consisting of a preset number of stitches.

As far as the apparatus for the implementation of the above operative method is concerned, it comprises in combination:—means for driving each of the stitch-forming needles in the direction of the respective longitudinal axis;—means for the removal of the stitches from the needles and the transfer thereof onto other knitting members of the same or other machine;—means for driving the stitch-removing and transferring means.

The advantages derived from the present invention lie essentially in that it is possible to operate the removal and the transfer of all or part of the article stitches from one member to another of the same machine or different machines, in a fully automatic manner and with an output significantly higher than that obtainable with traditional equipment, thereby allowing the production cost of the finished products to be drastically reduced. Another advantage of the present invention is that the operative method can be implemented both with rectilinear and circular or mixed machines. Still another advantage of the apparatus according to the invention is of relatively easy construction, cost-effective and reliable even after a prolonged duty life.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
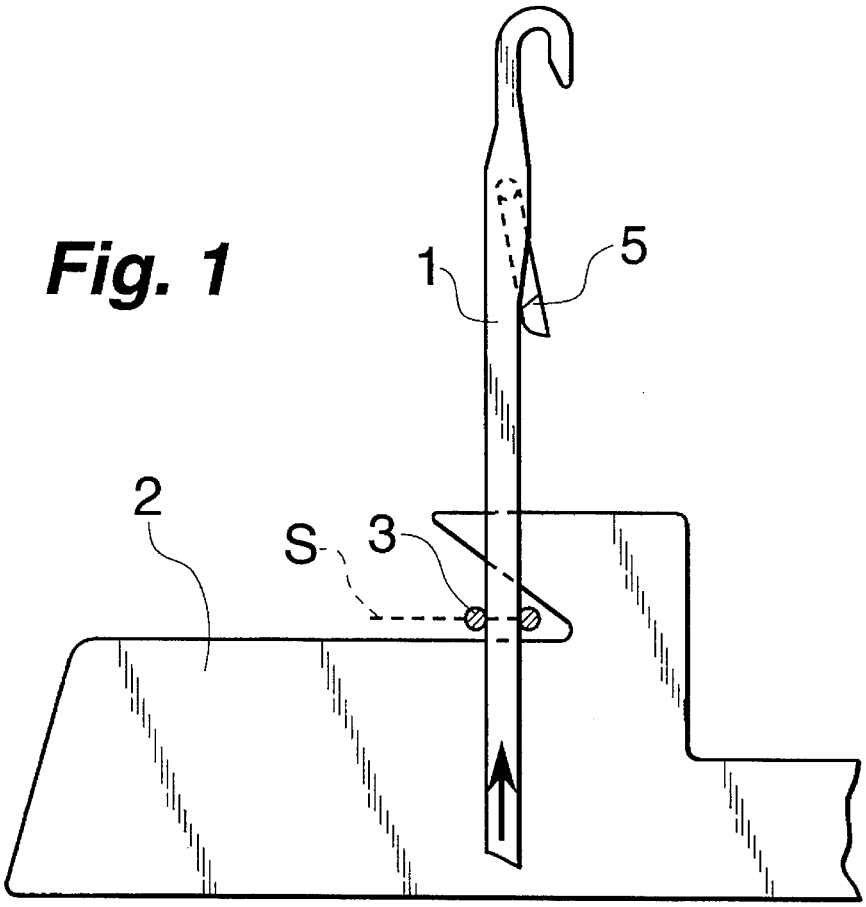
FIG. 1 shows schematically the detail of a knitting machine preset for allowing the removal and transfer of the stitches of a knit article according to the invention, the machine being of the type with movable sinkers 2, in which a latch-type needle is shown at the end of its lift, in a condition in which the sinkers are closed and the respective stitch is unloaded.
Figure 2:
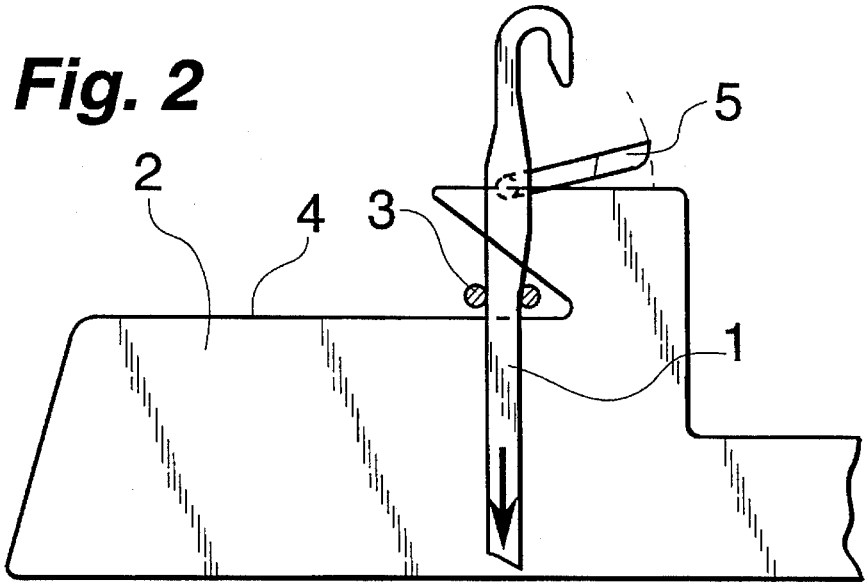
FIG. 2 shows the needle of FIG. 1 upon the lowering step, with the corresponding stitch 3 in the vicinity of the hinge of the relevant latch.
Figure 3:
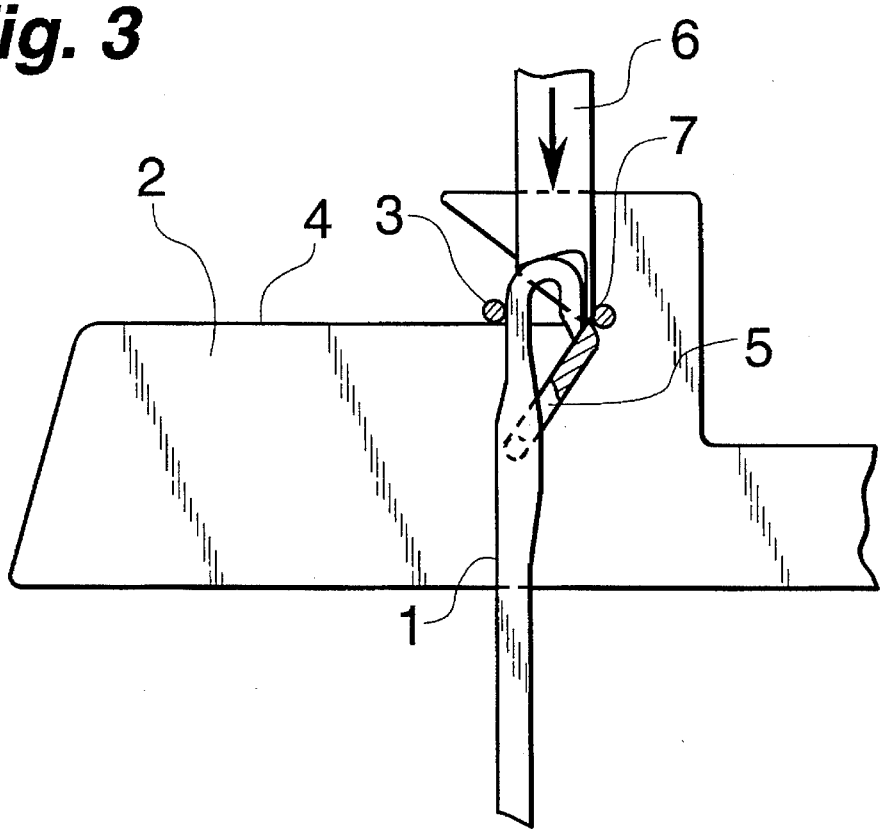
FIG. 3 shows schematically the needle of FIG. 2 upon the step of further lowering, with the stitch-removing means dose to the needle head, that is in the covering position, and with the stitch being astride of the respective latch.
Figure 4:
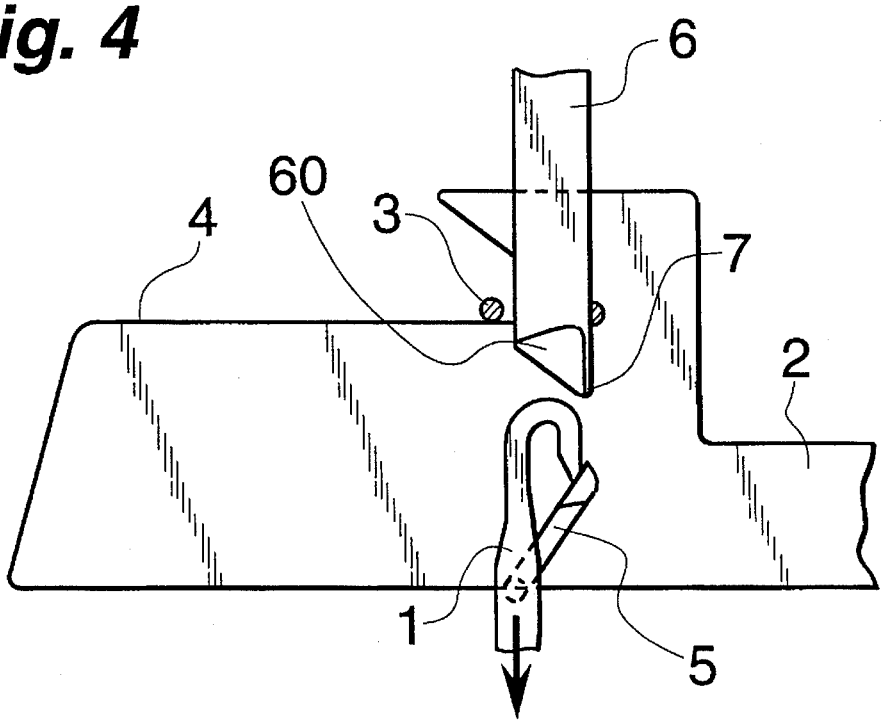
FIG. 4 shows the needle and the means of FIG. 3, in a step in which it is lowered still further, with the stitch-removing means being in an advanced position with respect to the preceding step and with the stitch fitted thereon.
Figure 5:
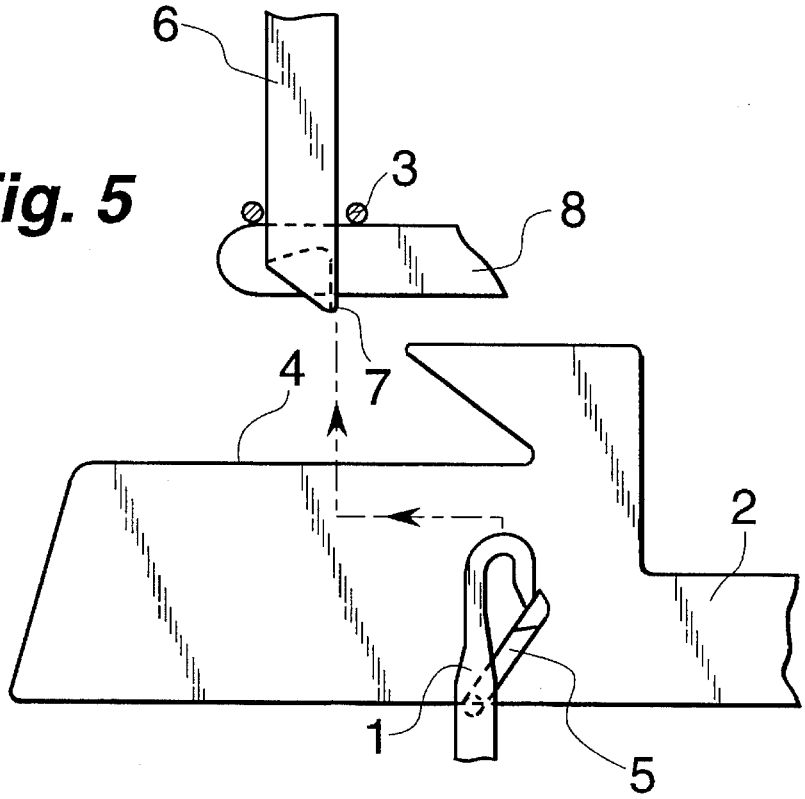
FIG. 5 shows the needle of FIG. 4, with the stitch-removing means in lifted position with respect to the preceding step and being released from the respective sinker, and means for supporting the stitch fitted on the removal means.
Figure 6:
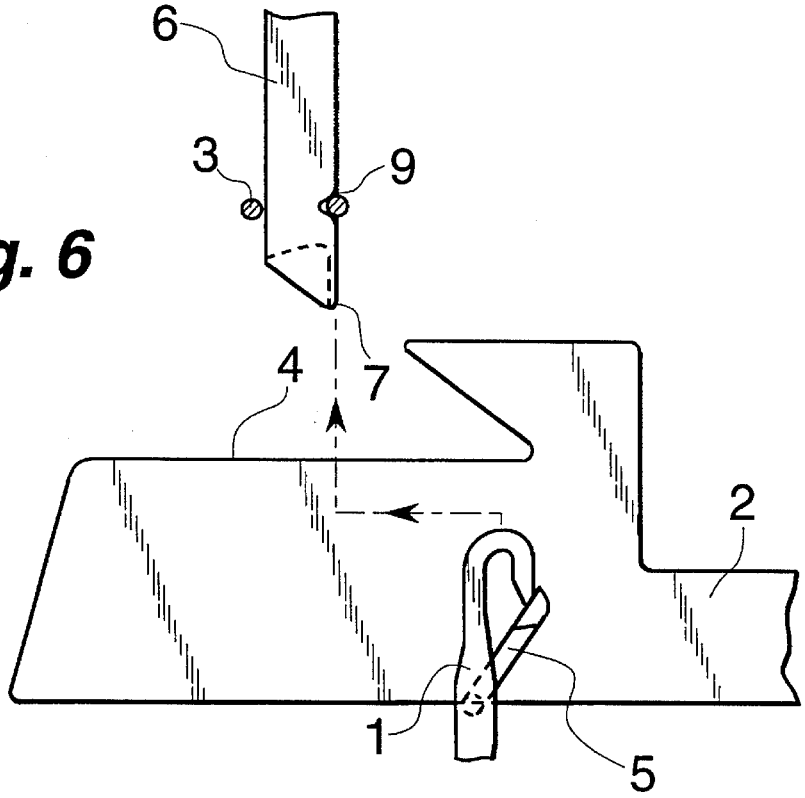
FIG. 6 shows schematically the stitch-removing and transferring means, according to an alternative embodiment.
Figure 7:
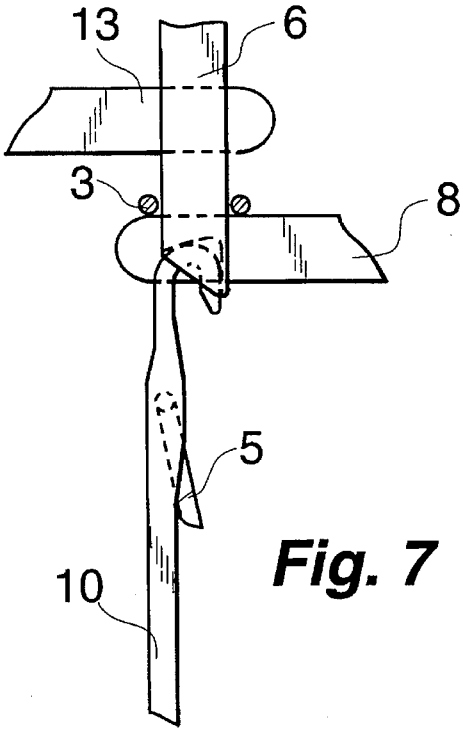
FIG. 7 shows schematically the stitch-removing means, with the stitch-supporting means, and means 13 for the transfer of the stitch from the respective removal means to a needle 10 of the same or other knitting machine, upon the initial step for the laying down or unloading of the stitch.

Reduced to its basic structure, and reference being made to the accompanying drawings, the present invention includes, a method for the removal of one or more stitches of an article from the knitting needles 1 of a knitting machine and the transfer and placement thereof onto other knitting members of the same or other machine. The method including the preliminary step of manufacturing a knit article with a machine provided with a plurality of knitting needles 1 of latch or skidded type, that is of compound type, and with a stitches 3—casting off plane 4. For each article stitch 3 to be removed and transferred, the following operation steps occur:

(a) lifting the knitting needle I which bears the stitch 3, with the sinkers 2 in an advanced position, that is, in closed condition, so as to place the stitch 3 in an unloaded condition (level S of FIG. 1), that is, below the open latch 5 of the needle;

(b) lowering the needle 1 so as to force the stitch 3 into place onto the casting off plane 4 which, in this case, is delimited by the sinkers 2 and, through a further lowering of the needle 1, to force the stitch 3 into motion on the needle neck placing it in the vicinity of the hinge of the respective latch 5;

(c) lowering further the needle 1 so as to cause the closing of the respective latch 5 by means of the same stitch 3 fitted thereon—the latter being prevented from sliding together with the needle 1 because of its resting on the casting off plane 4—and, prior to the complete closing of the latch 5, moving a stitch-removing element 6 close to the head of the needle 1 until it comes in contact with the head, thereby performing the covering of both the needle 1 and of the element 6 by the thus driven latch 5;

(d) lowering still further the needle 1 and the element 6, in order to insert the element 6 into the stitch 3 and thereby achieving the automatic transfer of the stitch from the needle 1 onto the element 6;

(e) transferring elsewhere the thus removed stitch 3 so as, for example, the continuation of the knitting formation of the article onto another machine or onto a needle of a different front of the same machine or onto another region of the same needles front, or the positioning of the stitch at a predetermined distance from the needle 1 in a stand-by condition, and allowing for the prosecution of the knitting operation, or the beginning of a subsequent duty cycle, on the needle 1 being freed of the stitch 3.

It is understood that the above operations may be repeated many times, so that a same element 6 will be able to remove more stitches 3 in succession. Then, the thus removed stitches 3 may be subjected to other subsequent work operations. In this way, it is possible, for example, to remove the end stitches 3 of two or more articles, or of one or more limbs of articles, in order to transfer them to a hook-up machine to operate the joining thereof, or to transfer them to another suitable knitting machine allowing the continuation of the knitting work.

According to the invention, the above described treatment may be operated on any number of article stitches 3, in so far as the elastic and dimensional characteristics of the stitches 3 allows. In case of removal of all the stitches, there is obtained the removal and transfer of the whole article. The stitches 3 may thus be removed and transferred also in groups, each group consisting of a predetermined number of stitches 3.

Advantageously, according to the invention, provision is made for moving the stitch 3 away from the needle 1 after the retention of the stitch 3 at a fixed and preset position on the means 6, to prevent the spontaneous release thereof.

Figure 8:
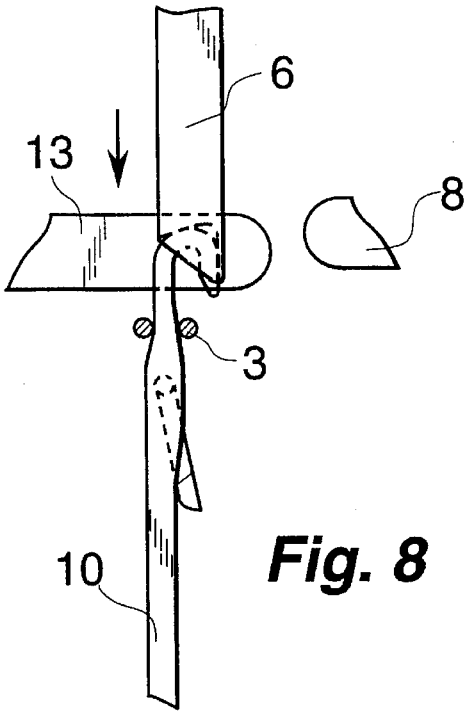
FIG. 8 shows the means of FIG. 7 with the stitch in laid down condition.
Figure 9:
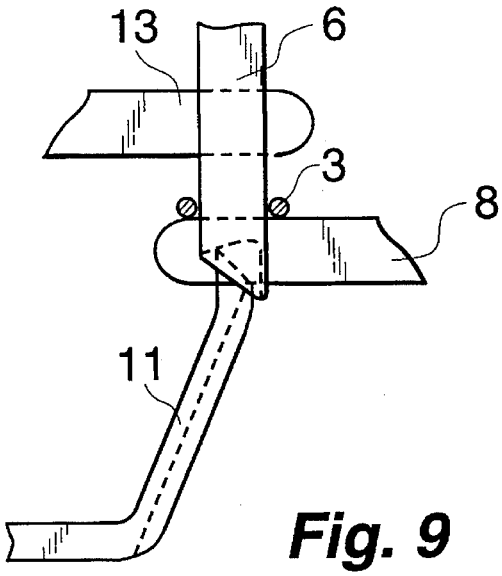
FIG. 9 shows schematically the stitch-removing and transferring means of FIG. 7 upon the initial step of stitch placement onto a spine of a hook-up machine 11.
Figure 10:
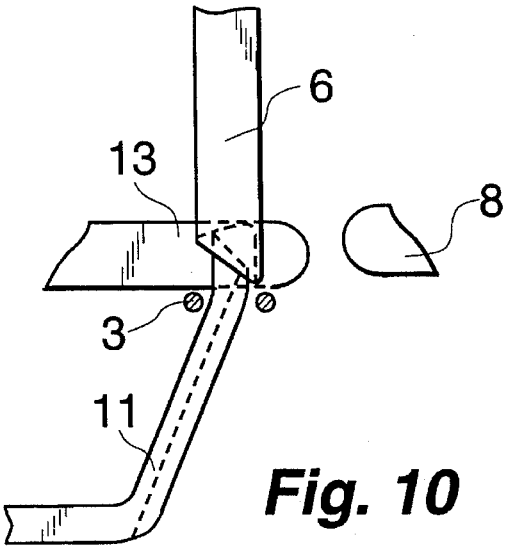
FIG. 10 shows the means of FIG. 9, with the stitch being laid down.
Figure 11:
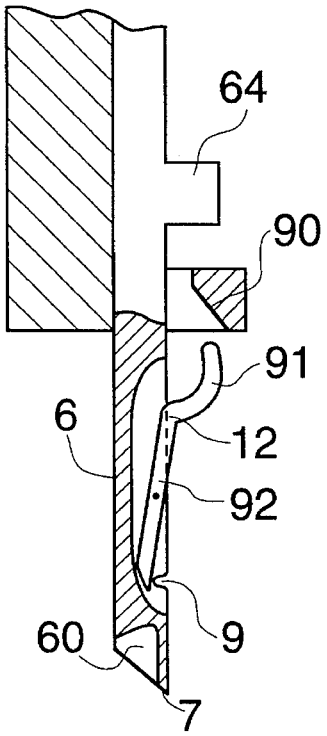
FIG. 11 shows schematically the stitch-removing means, according to an alternative embodiment, in their stitch-retaining condition.
Figure 12:
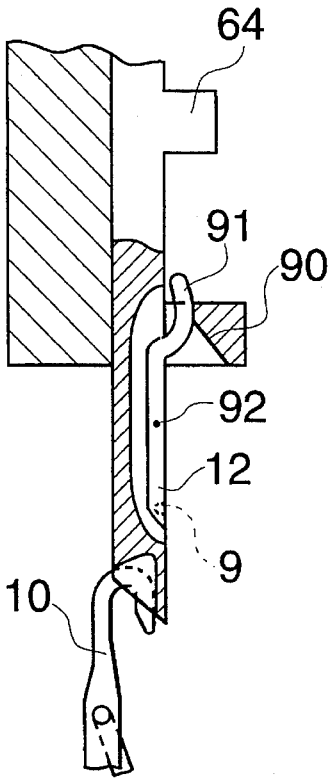
FIG. 12 shows the means of FIG. 11 in their allowable stitch-releasing condition.

Advantageously, according to the invention, reference being made to FIGS. 8 and 9 of the accompanying drawings, after the step (e) in which the stitch 3 moves away from the corresponding needle 1, provision is made to carry out the following operative steps:

driving the punch means 6 so as to dispose the stitch 3 above the head of a needle 10 other than the starting one 1. The needle 10 being possibly, for example, of the latch or skidded type, that is of compound type, or beak-type;

releasing the stitch 3 from the punch means 6 and fitting it on the neck of the needle 10.

Advantageously, according to the invention, reference being made to FIGS. 8 and 9 the accompanying drawings, after the step (e) in which the stitch 3 moves away from the needle 1, provision is made for laying down the stitch 3 onto a hooking up spine 11, for example for the finishing of the end stitches of the article, or the joining of one or more limbs of knit articles by means of a hooking up operation.

As far as the apparatus for implementing the operative method is concerned, it comprises known per se cam means for driving the needles 1, as well as means for individually removing and transferring the stitches 3 by means of a substantially fiat, so-called "punch" element 6, for each stitch 3 to be removed and transferred. Each element 6 is provided at its bottom with a groove 60 having the concavity substantially facing the head of a needle 1 loaded with the stitch 3. The groove 60 allows the crook of the corresponding needle 1 to be brought very close thereto, so as to operate the covering of the needle 1 and of the element 6 by the closing of the latch 5. The punch 6 being suitably supported and connected by a member or punch support means 61 to be either fixed or longitudinally slidable relative to the member 61.

Advantageously, according to the invention, each of the punches 6 is provided with a heel 64 engaged with an external member which drives it into motion, such as a cam 63 or a control bar 65 for driving the punches 6 sequentially or as a whole. The downwards driven motion of the punches 6 can be exploited for determining the corresponding lowering of the respective needle 1 after the contact between the punch 6 and the needle Each punch 6 may be provided with any member able to act as an interface to a corresponding control member.

Advantageously, according to the invention, the distance between two adjacent punches 6 is equal to the pitch or center-distance between the needles i or a multiple thereof.

Figure 15A:
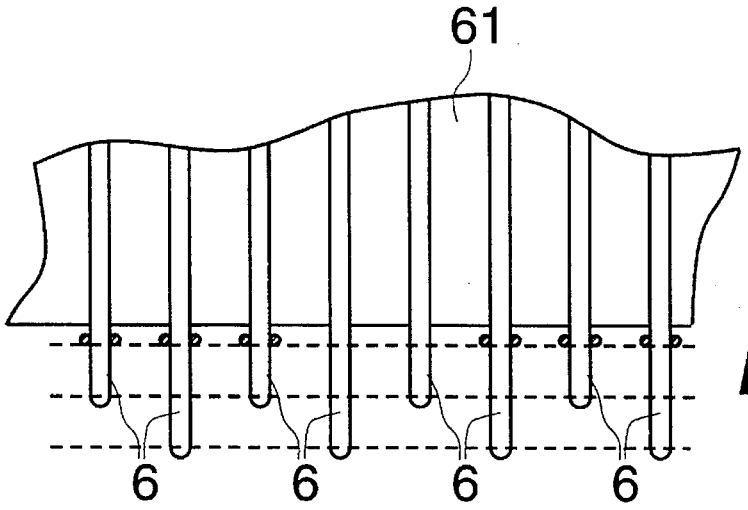
FIG. 15A shows schematically a group of removal means having lengths of two different values.
Figure 15B:
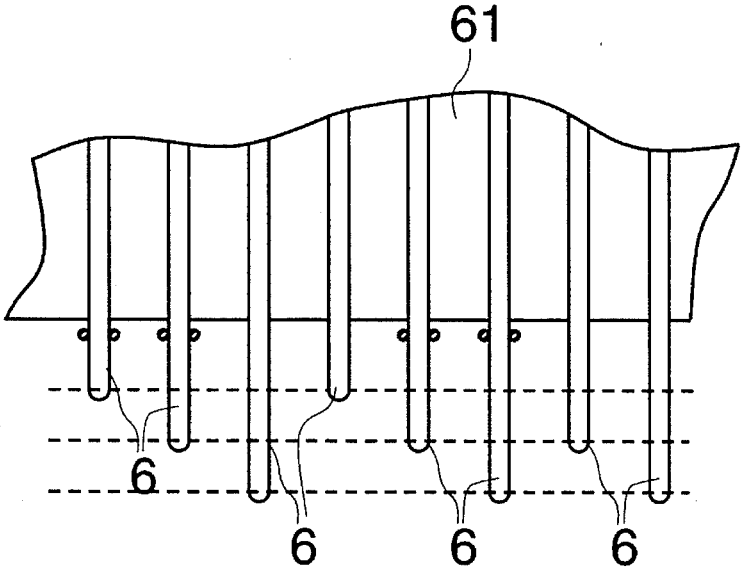
FIG. 15B shows schematically a group of removal members having lengths of three different values.
Figure 16:
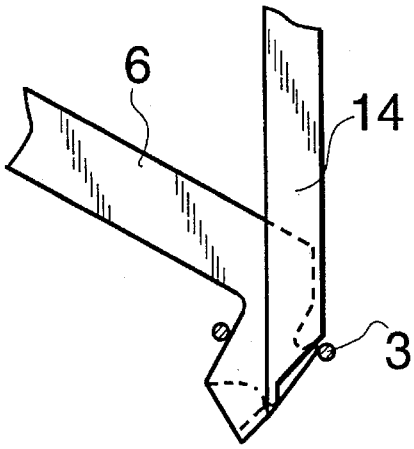
FIG. 16 shows the means of FIG. 13 in the final step of their predisposition for the stitch release.
Figure 17A:
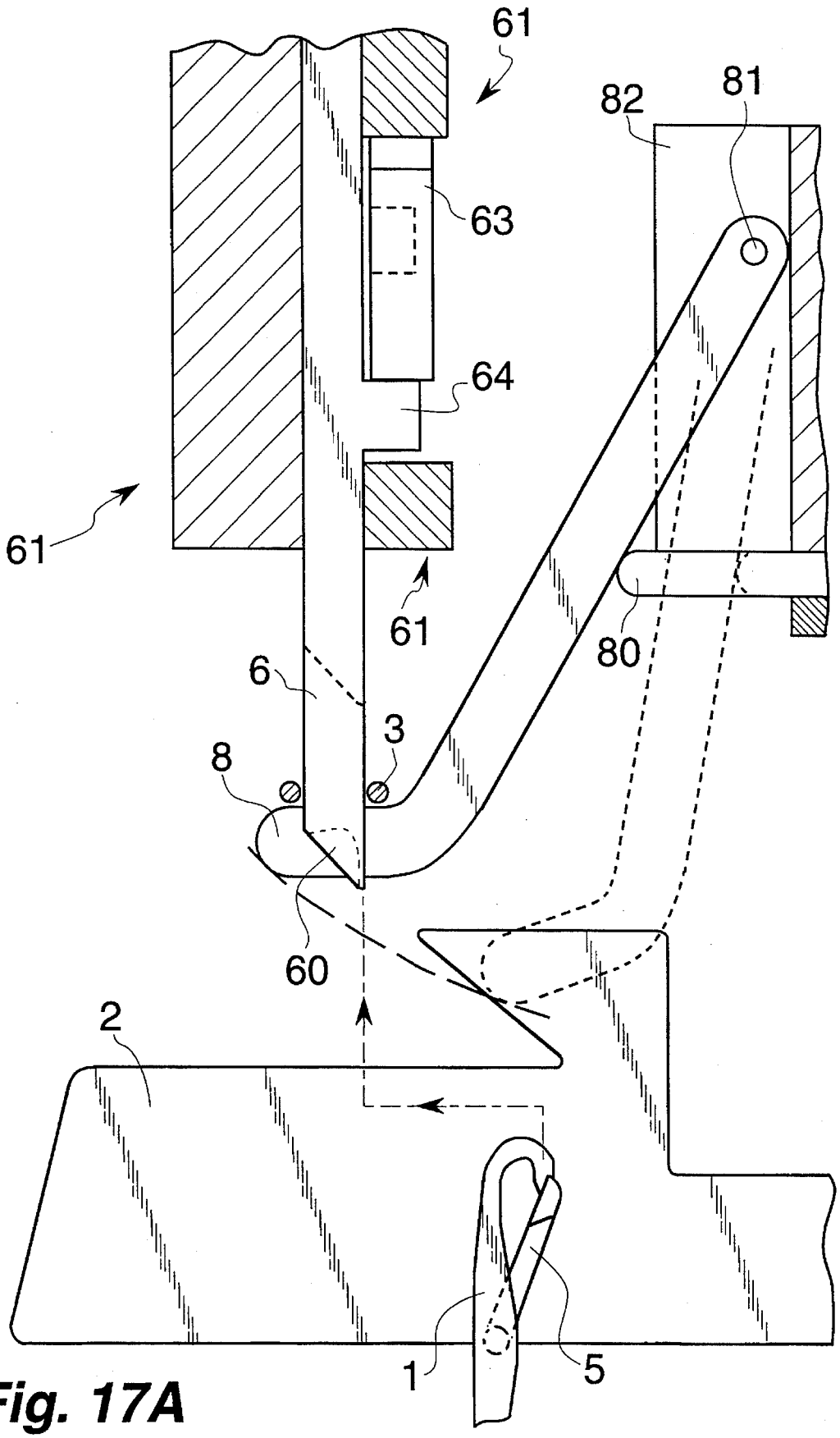
FIG. 17A, 17B, and 17C show schematically the stitch-removing and supporting means with respective support members.
Figure 17B:
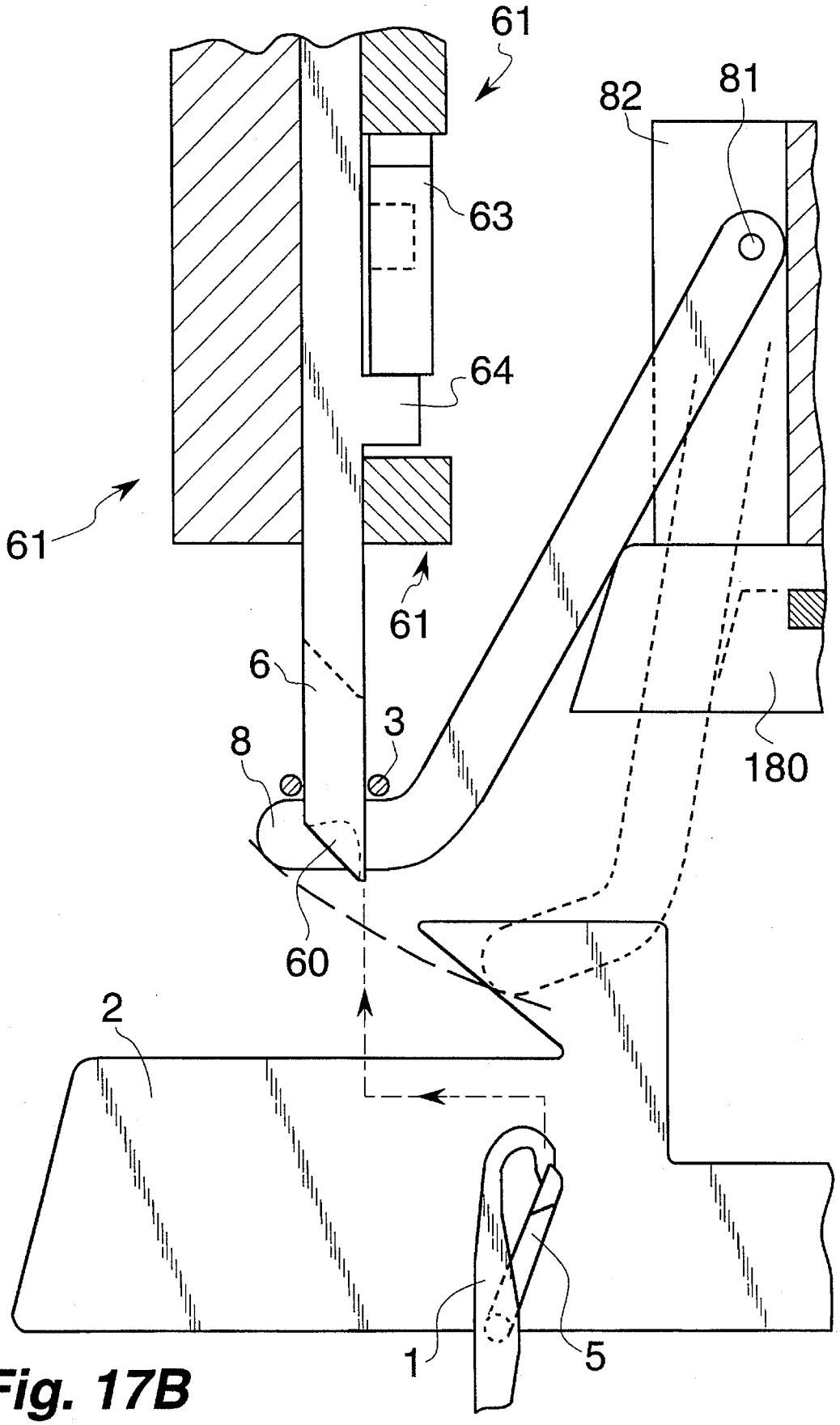
Figure 17C:
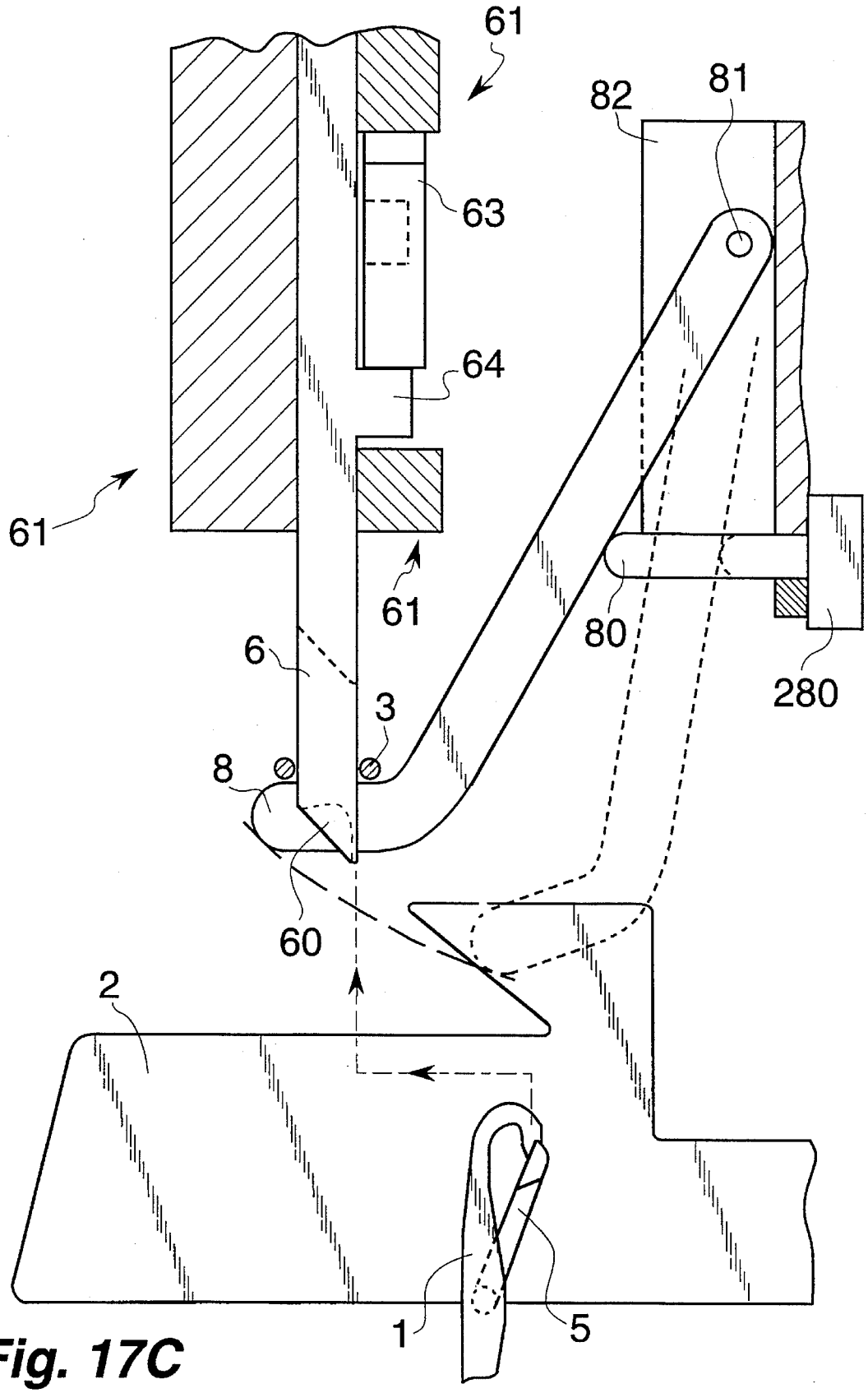
Figure 18:
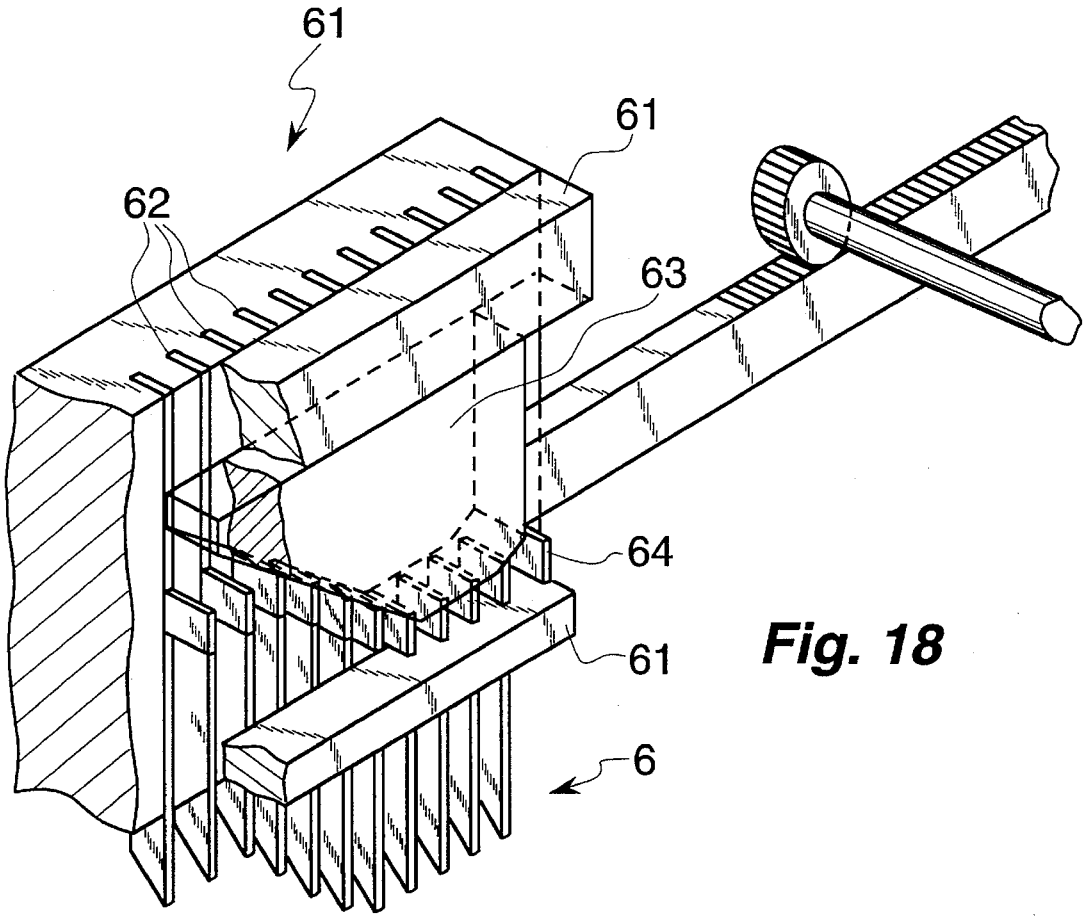
FIG. 18 shows schematically the stitch-removing means with respective driving means, according to a first embodiment.
Figure 19:
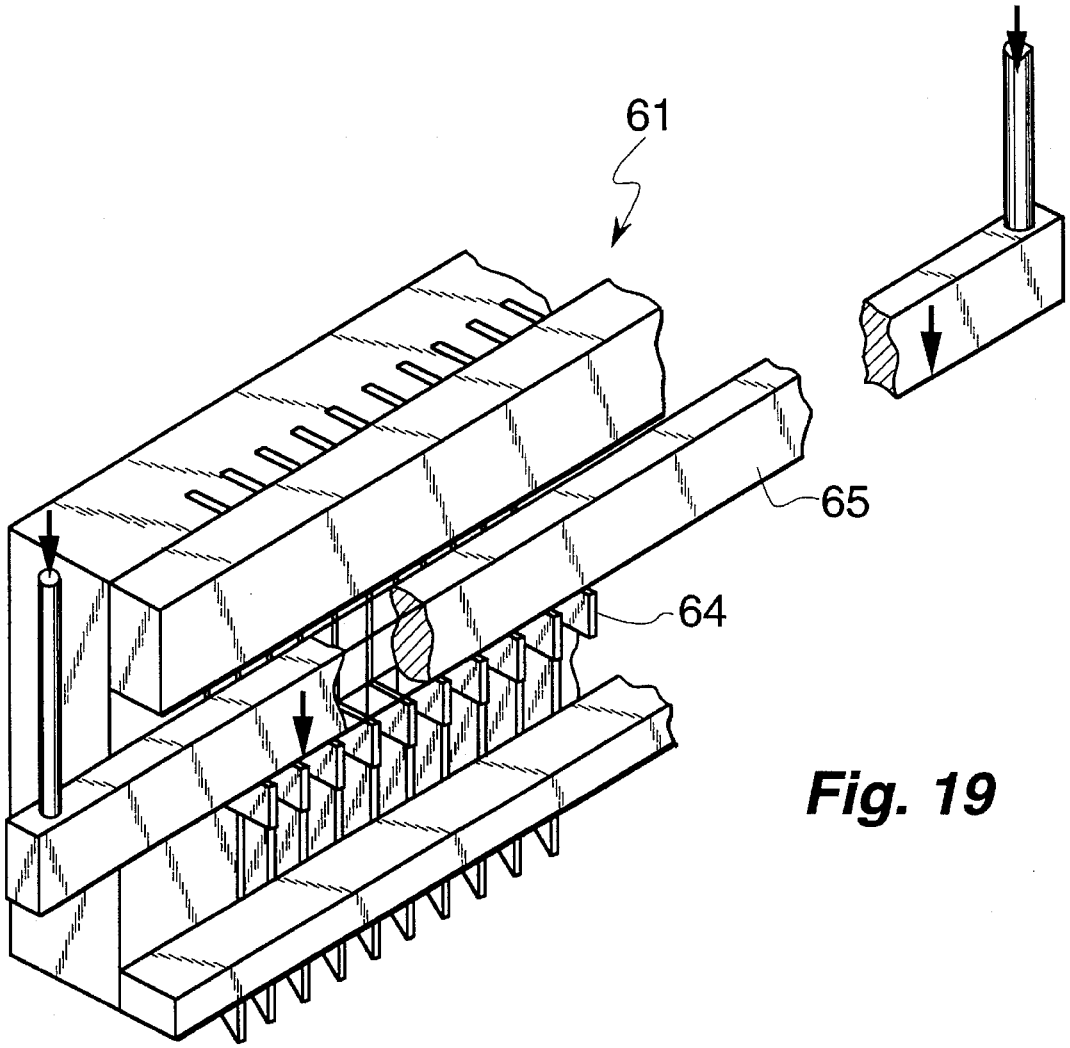
FIG. 19 shows schematically the stitch-removing means with respective driving means, according to a further embodiment.
Figure 21:
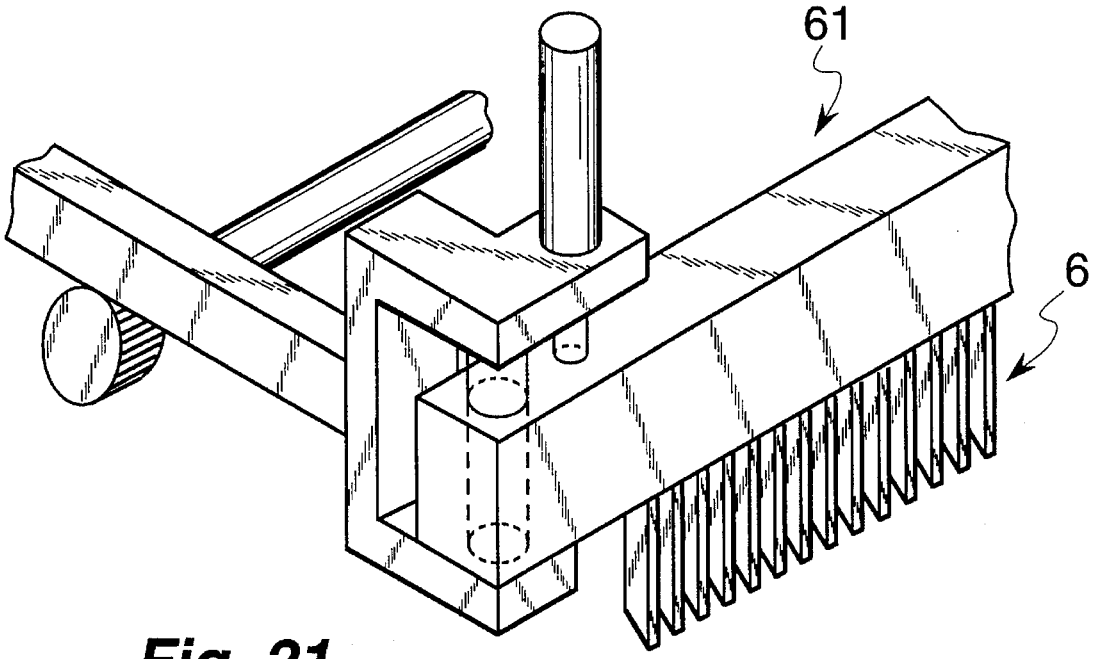
FIG. 21 shows schematically a group of removal members with means for driving them in two directions at right angle to each other.
Figure 20:
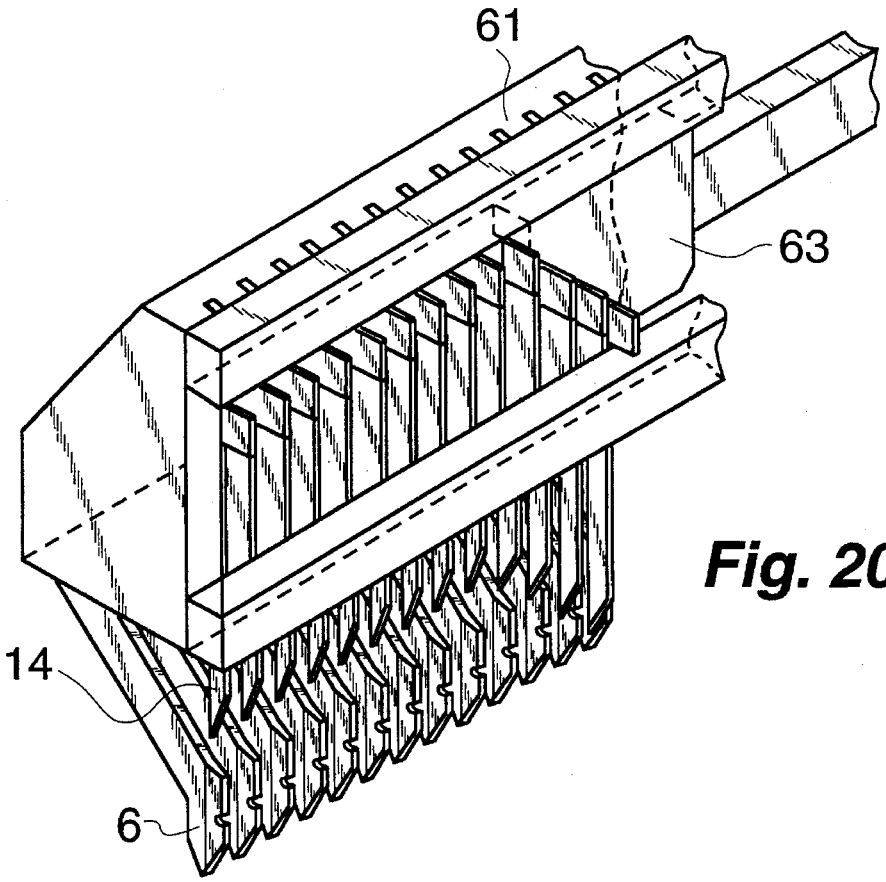
FIG. 20 shows schematically the means provided for operating the means of FIG. 16.

The punches 6 are all of the same or different length, depending on the type of treatment to be carried out on the stitches 3. More specifically, reference being made to FIGS. 15A and 15B of the accompanying drawings, if the punches 6 are intended to perform the simultaneous removal of all the article stitches 3, their length will be the same for all of them, so that the respective free ends 7, that is, those intended for covering the respective needles 1, will result always at the same level with respect to the casting off plane 4 of the machine. If not intended to perform the simultaneous removal of adjacent stitches 3, punches 6 adjacent between them will have different lengths so that the free end 7 of the punches 6 operating the removal of the stitches 3 will result at a level, with respect to the casting off plane 4 of the machine, which is different from that of the other punches 6 of the group. This prevents the thus treated stitches 3 from being unduly enlarged.

According to a first embodiment of the invention, the punches 6 are fixed to the support 61. In this case, the driven motion of the punches 6 is obtained from the corresponding driven motion of the support 61 which, in turn, can be operated by actuator cylinders and guided onto corresponding rails or the like.

According to a second embodiment of the invention, the punches 6 are individually received into corresponding, substantially rectilinear grooves 62 of the support 61 so as to be bidirectionally driven along the respective longitudinal direction with respect to the support 61. In this case, the driven motion of the punches 6 with respect to support 61 is obtainable either from cam means 63 or by a control bar 65, acting on the relevant heels 64 or equivalent members, depending whether the punches 6 are to be driven into motion individually, in sequence, or simultaneously displaced to and from the knitting head of the machine. In any case, the grooves 62 may have shape and development other than those illustrated in the figures of the accompanying drawings.

In case of punches 6 movable with respect to the support 61, the driving of the punches 6 into motion for the removal and transfer of the stitches 3 can be obtained b combining the motion of the support 61 for displacements of greater extent, with that of the punches 6 relative to the support 61 for displacements of minor extent. In this way, it is also possible to differentiate the relative displacements between the various punches of the support and/or select the punches to be driven into motion.

Advantageously, according to the invention, the support 61 is subdivided into a plurality of distinct sections, each with a preset number of punches 6, so as to further differentiate the movements of the punches 6 of the apparatus, and thus extending further on the range of removals of stitches 3 that can be carried out and allowing for a higher number of possible work operations.

Figure 13:
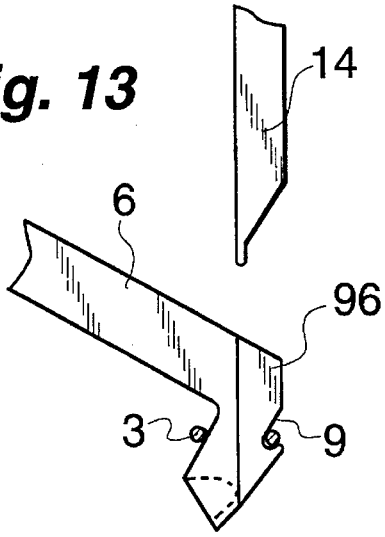
FIG. 13 shows schematically the stitch-removing means, according to an alternative embodiment, in their stitch-retaining condition.
Figure 14:
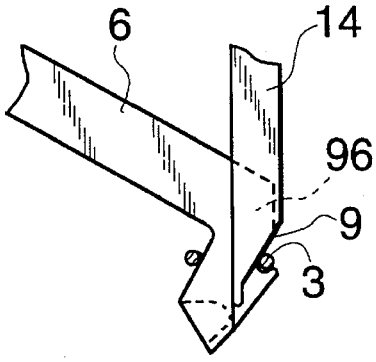
FIG. 14 shows the means of FIG. 13, upon the initial step of allowable stitch-releasing condition.

Each of the punches 6 may also be formed with a stem having its axis inclined with respect to the portion of the front end 7, as illustrated in the FIGS. 13 and 14 of the accompanying drawings.

Advantageously, according to the invention, means are provided for retaining each of the stitches 3 at a fixed and preset position on the corresponding punch 6. The means consist, according to a first embodiment, of a recess 9 provided on each of the punches 6 at a preset distance from the respective free end 7, and intended to retain the corresponding stitch 3 being removed by the effect of its own elasticity. Alternatively, the means holding the stitch 3 on the support 6 may consist of a rod 8 able to be driven to a position below the stitch 3 fitted on the respective punch 6, so as to prevent the spontaneous release of the same stitch. The rod 8 is apt to be associated to a corresponding control member including, for example of a peg 80. The control member is able to drive the rod into rotation about a pivot 81. The pivot 81 connecting the same rod 8 with a corresponding support member 82. The function of the peg 80 may also be carried out by a cam 180 rotating about an axis parallel to the axis of the punch 6, or by an actuator cylinder 280 with a peg 80 acting on the rod 8.

This prevents the fabric from moving off of the punches 6 during the transfer of the stitches 3.

Means are also advantageously provided for releasing each stitch 3 from the respective punch 6. The stitch releasing means including, according to a first embodiment, a flat release element 13 acting on the stitch 3 located on the punch 6, with a thrust-operated drive towards the free end of the punch 6. This drive causing the transfer thereof onto the intended knitting member such as, for example, the needle 10 or the spine 11 illustrated in the figures of the accompanying drawings. Alternatively, in order to release the stitch 3 retained by the recess 9 of the respective punch 6, a peg 12 is provided rotating about a pivot 92. The pivot 92 connects the peg 12 to the punch 6, so as to allow the covering of the recess 9, and thus the release of the stitch 3 from the recess 9. The peg 12 being operated under control such as by cam means 90 acting sideways on the upper free end 91 of the peg 12 when the punch 6 is driven in the respective longitudinal direction. The lifting of the punch 6 caused by the reaction exerted by the knit member—for example, the needle 10—onto which it is made to rest causes the covering of the recess 9. The uncovering of the recess 9 is caused by the lowering of the punch 6 upon the predisposition of the latter for the removal of the respective stitch 3.

In a further embodiment, as illustrated in FIGS. 13 and 14 of the accompanying drawings, the stitch releasing means consist of a peg 14 with substantially rectilinear axis whose free end is intended to slide adjacent to the corresponding end of the punch 6. The end of the punch being suitably formed with a rectilinear slot 96 allowing the peg 14 to be moved close to and away from the respective recess 9 so as to operate the covering and uncovering respectively thereof. The free end of the peg 14 is to be inserted inside the stitch 3 thereby enlarging the stitch 3 and allow for unloading of the stitch 3.

Advantageously, according to the invention, the free end of the peg 14 is wedge-shaped and laterally bent to be oriented towards the punch 6.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

We claim:

1. A method for removing stitches from needles, the method comprising the steps of:

providing a compound type needle with a latch and a stitch latched in a hook of said needle;

providing a sinker in a closed position with respect to said needle;

lifting said needle with respect to said sinker to move the stitch out and away from said hook and said latch while the stitch is on said needle and in an unlatched condition;

providing a punch means for receiving the stitch from said needle;

moving an end of said punch means into contact with said hook;

lowering said needle with respect to said sinker to move the stitch towards said hook and to close said latch with the stitch being outside said latch and said hook, said latch in a closed position covering said hook and a portion of said punch means, said lowering also moving the stitch off of said needle and onto said punch means;

moving said punch means with the stitch away from said needle.

2. A method in accordance with claim 1, wherein:

said punch includes retention means for holding the stitch;

the stitch is moved on said punch means away from said ends of said punch means and toward said retention means.

3. A method in accordance with claim 1, further comprising:

moving said punch means with the stitch toward another needle;

moving the stitch on said punch means onto a neck of said another needle.

4. A method in accordance with claim 1, further comprising:

moving said punch means with the stitch toward a hooking up spine;

moving the stitch on said punch means onto a neck of said hooking up spine.

5. A method in accordance with claim 1, wherein:

said punch means repetitively removes a plurality of stitches from a plurality of needles.

6. A method in accordance with claim 1, wherein:

said lowering of said needle is caused in part by force from said punch means.

7. An apparatus for removing stitches from needles, the apparatus comprising:

a compound type needle with a latch means for latching a stitch in a hook of said needle;

a casting off plane with means for moving the stitch longitudinally on said needle;

punch means for receiving the stitch from said needle, said punch means having an end defining a groove substantially complementary to said hook and a portion of said end of said punch means being coverable by said latch in a closed condition when said end of said punch means is in contact with said hook;

punch support means for one of fixedly or longitudinally slidably supporting said punch means.

8. An apparatus in accordance with claim 7, wherein:

said punch means includes a heel;

control means engages said heel for reciprocatingly moving said punch means in a longitudinal direction of said punch means.

9. An apparatus in accordance with claim 7, wherein:

a plurality of said punch means and a plurality of said needles are provided, a distance between adjacent said punch means is substantially equal to one of a distance between adjacent said needles and a multiple of said distance between adjacent said needles.

10. An apparatus in accordance with claim 9, wherein:

said plurality of punch means are one of a same length and different lengths.

11. An apparatus in accordance with claim 7, wherein:

said punch means is fixed to said punch support and a drive means is engaged with said punch support for driving said punch means.

12. An apparatus in accordance with claim 9, wherein:

said punch support means defines a plurality grooves, each of said grooves corresponding to one of said punch means, said grooves guiding a corresponding punch means in a longitudinal direction.

13. An apparatus in accordance with claim 8, wherein:

said control means includes one of a cam and control bar acting on said heel.

14. An apparatus in accordance with claim 7, wherein:

said punch support means includes a plurality of sections, each of said sections including a plurality of said punch means.

15. An apparatus in accordance with claim 7, wherein:

said punch means includes a stem spaced from said end of said punch means, said stem having a longitudinal axis angularly spaced from a longitudinal axis of said end of said punch means.

16. An apparatus in accordance with claim 7, wherein:

said punch includes retention means for holding the stitch in a fixed and preset position on said punch means.

17. An apparatus in accordance with claim 16, wherein:

said retention means is a groove defined by said punch means and retaining the stitch by elasticity of the stitch, said groove on said punch means being spaced from said end of said punch means.

18. An apparatus in accordance with claim 16, wherein:

said retention means includes a rod drivable to a blocking position between the stitch on said punch means and said end of said punch means to block movement of the stitch towards said end of said punch.

19. An apparatus in accordance with claim 18, wherein:

said retention means also includes a retention support and a pivot connecting said rod with said retention support, said retention means also including a retention control means with a peg for pivoting said rod into said blocking position.

20. An apparatus in accordance with claim 18, wherein:

said retention means also including a retention control means with a cam for pivoting said rod into said blocking position.

21. An apparatus in accordance with claim 18, wherein:

said retention means also including a retention control means with an actuator cylinder means for moving said rod into said blocking position.

22. An apparatus in accordance with claim 7, further comprising:

stitch releasing means for releasing the stitch from said punch means.

23. An apparatus in accordance with claim 22, wherein:

said punch includes retention means for holding the stitch in a fixed and preset position on said punch means, said retention means is a groove defined by said punch means and retaining the stitch by elasticity of the stitch;

said stitch releasing means includes a peg rotatable about a pivot on said punch means between a first and second position, said peg covering said recess in said first position and releasing the stitch from said recess, said peg being movable by a cam means acting on said peg, said cam means causing said peg to cover said recess when said punch means is moved in a longitudinal direction by said needle, said cam means uncovering said recess when said punch means moves away from said cam means.

24. An apparatus in accordance with claim 22, wherein:

said punch means includes retention means for holding the stitch in a fixed and preset position on said punch means, said retention means is a groove defined by said punch means and retaining the stitch by elasticity of the stitch, said punch means also defines a slot adjacent said recess;

said stitch releasing means includes a peg with an end slidable along said slot of said punch means for covering and uncovering said recess, said peg being insertable into the stitch during covering of said recess and enlarging the stitch.

25. An apparatus in accordance with claim 24, wherein:

said end of said peg is wedge shaped and laterally bent to be orientated toward said punch means.

26. An apparatus for removing stitches from needles, the apparatus comprising:

a compound type needle with a latch means for latching a stitch in a hook of said needle;

a casting off plane with means for moving the stitch longitudinally on said needle;

punch means for receiving the stitch from said needle, said punch means having an end defining a groove substantially complementary to said hook and a portion of said end of said punch means being coverable by said latch in a closed condition when said end of said punch means is in contact with said hook;

punch support means for one of fixedly or longitudinally slidably supporting said punch means;

stitch releasing means for releasing the stitch from said punch means, said stitch releasing means includes a release element movable along said punch means toward said end of said punch means to move the stitch off of said punch means onto another needle.

* * * * *